US011339038B2

(12) United States Patent
Hand et al.

(10) Patent No.: US 11,339,038 B2
(45) Date of Patent: May 24, 2022

(54) SYSTEM FOR CONTROLLING THE OPERATION OF A HYDRAULIC WINCH

(71) Applicant: Caterpillar Inc., Deerfield, IL (US)

(72) Inventors: Timothy L. Hand, Metamora, IL (US); Andrew J. Kieser, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 578 days.

(21) Appl. No.: 16/217,387

(22) Filed: Dec. 12, 2018

(65) Prior Publication Data

US 2020/0190769 A1 Jun. 18, 2020

(51) Int. Cl.

| | |
|---|---|
| ***B66D 1/50*** | (2006.01) |
| ***E02F 9/20*** | (2006.01) |
| ***B66D 1/08*** | (2006.01) |
| ***B66D 1/48*** | (2006.01) |
| *B66D 5/26* | (2006.01) |

(52) U.S. Cl.

CPC ..... *B66D 1/50* (2013.01); *B66D 1/08* (2013.01); *B66D 1/48* (2013.01); *E02F 9/2016* (2013.01); *B66D 5/26* (2013.01); *B66D 2700/0133* (2013.01); *B66D 2700/0158* (2013.01); *B66D 2700/035* (2013.01)

(58) Field of Classification Search

CPC ... B66D 1/50; B66D 1/48; B66D 1/08; B66D 5/26; B66D 2700/035; B66D 2700/0158; B66D 2700/0133; E02F 9/2016

See application file for complete search history.

(56) References Cited

U.S. PATENT DOCUMENTS

| | | | | |
|---|---|---|---|---|
| 2,683,318 | A | 7/1954 | Tourneau | |
| 3,249,336 | A | 5/1966 | Brown et al. | |
| 3,618,897 | A * | 11/1971 | Swoboda, Jr. | F16H 61/46 254/270 |
| 4,078,770 | A | 3/1978 | Yates et al. | |
| 4,519,585 | A * | 5/1985 | Furrow | B66D 1/50 254/273 |
| 7,063,306 | B2 * | 6/2006 | Sanders | B66D 1/485 254/361 |
| 9,702,111 | B2 | 7/2017 | Sokoloski | |
| 2012/0253610 | A1 | 10/2012 | Anders et al. | |
| 2017/0203940 | A1 * | 7/2017 | Holmberg | B66D 1/505 |

* cited by examiner

*Primary Examiner* — Sang K Kim
*Assistant Examiner* — Nathaniel L Adams
(74) *Attorney, Agent, or Firm* — Leydig, Voit & Mayer, Ltd.

(57) ABSTRACT

A system for controlling a winch assembly having a hydraulic motor, a drum, a cable, and a cable tension sensor. A controller is configured to access a winch load threshold defining a hold zone and a reel zone, and one of the hold zone and the reel zone including loads greater than the winch load threshold and another of the hold zone and the reel zone including loads less than the winch load threshold. The controller is further configured to determine whether the winch assembly is operating within the hold zone or the reel zone, and generate a zero flow command while the winch assembly is operating within the hold zone to prevent rotation of the hydraulic winch motor, and generate a pressure differential command while the rotatable winch drum is operating within the reel zone to permit rotation of the hydraulic winch motor.

18 Claims, 9 Drawing Sheets

SYSTEM FOR CONTROLLING THE OPERATION OF A HYDRAULIC WINCH

TECHNICAL FIELD

This disclosure relates generally to winches on movable machines and, more particularly, to a system and method for controlling the operation of a hydraulic winch.

BACKGROUND

Machines such as dozers often include a winch. The winch may be used to perform a variety of tasks and operate in different modes. These modes permit the winch cable to be reeled in or reeled out in a controlled manner to permit an operator perform a desired task. Mechanical winch assemblies are often difficult or challenging to control. Hydraulic winch assemblies may require a substantial amount of cooling capability in order to prevent overheating.

In some operations, when operating a machine such as an excavator along a steep slope, one or more dozers may be interconnected by winch cables to the machine on the slope. It is typically desirable for the dozer closest to the machine operating on the steep slope to have an experienced operator due to the complexity of the winch operation and risks associated with supporting the machine on the steep slope. However, experienced winch operators may not be available.

U.S. Pat. No. 3,249,336 discloses a machine having a hydraulically driven winch assembly. A hydraulic motor drives a drive shaft operatively connected to a shaft of the winch drum on which the winch cable is disposed. The drive shaft of the hydraulic motor is operatively connected to the shaft of the winch drum through a pair of bevel gears.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In a first aspect, a system for controlling an operation of a winch assembly includes a rotatable winch drum, a winch cable, a hydraulic winch motor, a cable tension sensor, and a controller. The winch cable is wrapped around the rotatable winch drum, the winch motor is operatively connected to the rotatable winch drum and includes a first port and second port for receiving hydraulic fluid, and the cable tension sensor is operatively connected to the winch cable and configured to generate tension data indicative of a tension on the winch cable. The controller is configured to access a winch load threshold, with the winch load threshold defining a hold zone and a reel zone of the winch assembly, and one of the hold zone and the reel zone including loads on the winch cable greater than the winch load threshold and another of the hold zone and the reel zone including loads on the winch cable less than the winch load threshold. The controller is further configured to determine whether the winch assembly is operating within the hold zone or the reel zone based upon the tension data from the cable tension sensor, generate a zero flow command to prevent flow of hydraulic fluid to the hydraulic winch motor while the winch assembly is operating within the hold zone and preventing rotation of the hydraulic winch motor, and generate a pressure differential command to permit a desired flow of hydraulic fluid to the hydraulic winch motor at a desired pressure differential while the rotatable winch drum is operating within the reel zone, with the desired flow of hydraulic fluid being based upon the winch load threshold and operating to permit rotation of the hydraulic winch motor.

In another aspect, a method of controlling an operation of a winch includes accessing a winch load threshold with the winch load threshold defining a hold zone and a reel zone of the winch assembly, and one of the hold zone and the reel zone including loads on a winch cable wrapped around a rotatable winch drum being greater than the winch load threshold and another of the hold zone and the reel zone including loads less than the winch load threshold. The method further includes determining whether the winch assembly is operating within the hold zone or the reel zone based upon the tension data from the cable tension sensor, with the cable tension sensor being operatively associated with the winch cable and the tension data being indicative of a tension on the winch cable, generating a zero flow command to prevent flow of hydraulic fluid to the hydraulic winch motor while the winch assembly is operating within the hold zone and preventing rotation of the hydraulic winch motor, and generating a pressure differential command to permit a desired flow of hydraulic fluid to the hydraulic winch motor at a desired pressure differential while the rotatable winch drum is operating within the reel zone, with the desired flow of hydraulic fluid being based upon the winch load threshold and operating to permit rotation of the hydraulic winch motor.

In still another aspect, a machine includes a prime mover, a ground-engaging drive mechanism, a winch assembly, and a controller. The ground-engaging drive mechanism is operatively coupled to the prime mover to propel the machine. The winch assembly includes a rotatable winch drum, a winch cable, a hydraulic winch motor, a cable tension sensor, and a controller. The winch cable is wrapped around the rotatable winch drum, the winch motor is operatively connected to the rotatable winch drum and includes a first port and second port for receiving hydraulic fluid, and the cable tension sensor is operatively associated with the winch cable and configured to generate tension data indicative of a tension on the winch cable. The controller is configured to access a winch load threshold, with the winch load threshold defining a hold zone and a reel zone of the winch assembly, and one of the hold zone and the reel zone including loads on the winch cable greater than the winch load threshold and another of the hold zone and the reel zone including loads on the winch cable less than the winch load threshold. The controller is further configured to determine whether the winch assembly is operating within the hold zone or the reel zone based upon the tension data from the cable tension sensor, generate a zero flow command to prevent flow of hydraulic fluid to the hydraulic winch motor while the winch assembly is operating within the hold zone and preventing rotation of the hydraulic winch motor, and generate a pressure differential command to permit a desired flow of hydraulic fluid to the hydraulic winch motor at a desired pressure differential while the rotatable winch drum is operating within the reel zone, with the desired flow of hydraulic fluid being based upon the winch load threshold and operating to permit rotation of the hydraulic winch motor.

DETAILED DESCRIPTION

Figure 1:
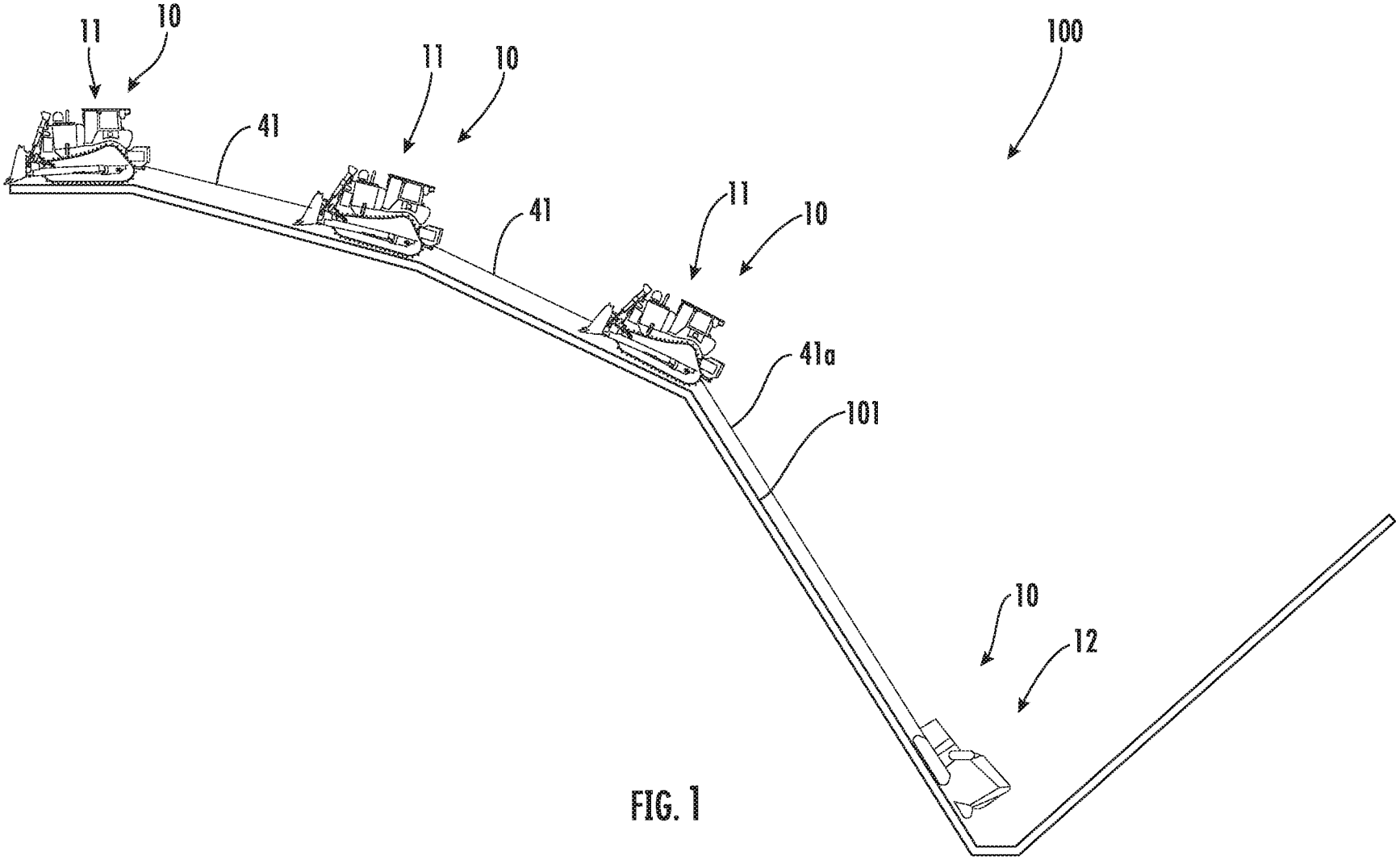
FIG. 1 depicts a diagrammatic illustration of a work site at which a machine incorporating the principles disclosed herein may be used.

FIG. 1 depicts a diagrammatic illustration of a work site 100 at which one or more machines 10 may operate to perform a desired task. Work site 100 may be a portion of a mining site, a landfill, a quarry, a construction site, or any other area. As depicted, work site 100 includes a group of dozers 11 that are interconnected by winch cables 41 and cooperatively support, through a further winch cable 41*a*, another machine such as an excavator 12 that is operating on a sloped work surface 101 configured as a steep slope. As described in more detail below, each dozer 11 includes a winch assembly 40 for controlling the winding and unwinding of the winch cable 41 operatively associated with that machine.

Figure 2:
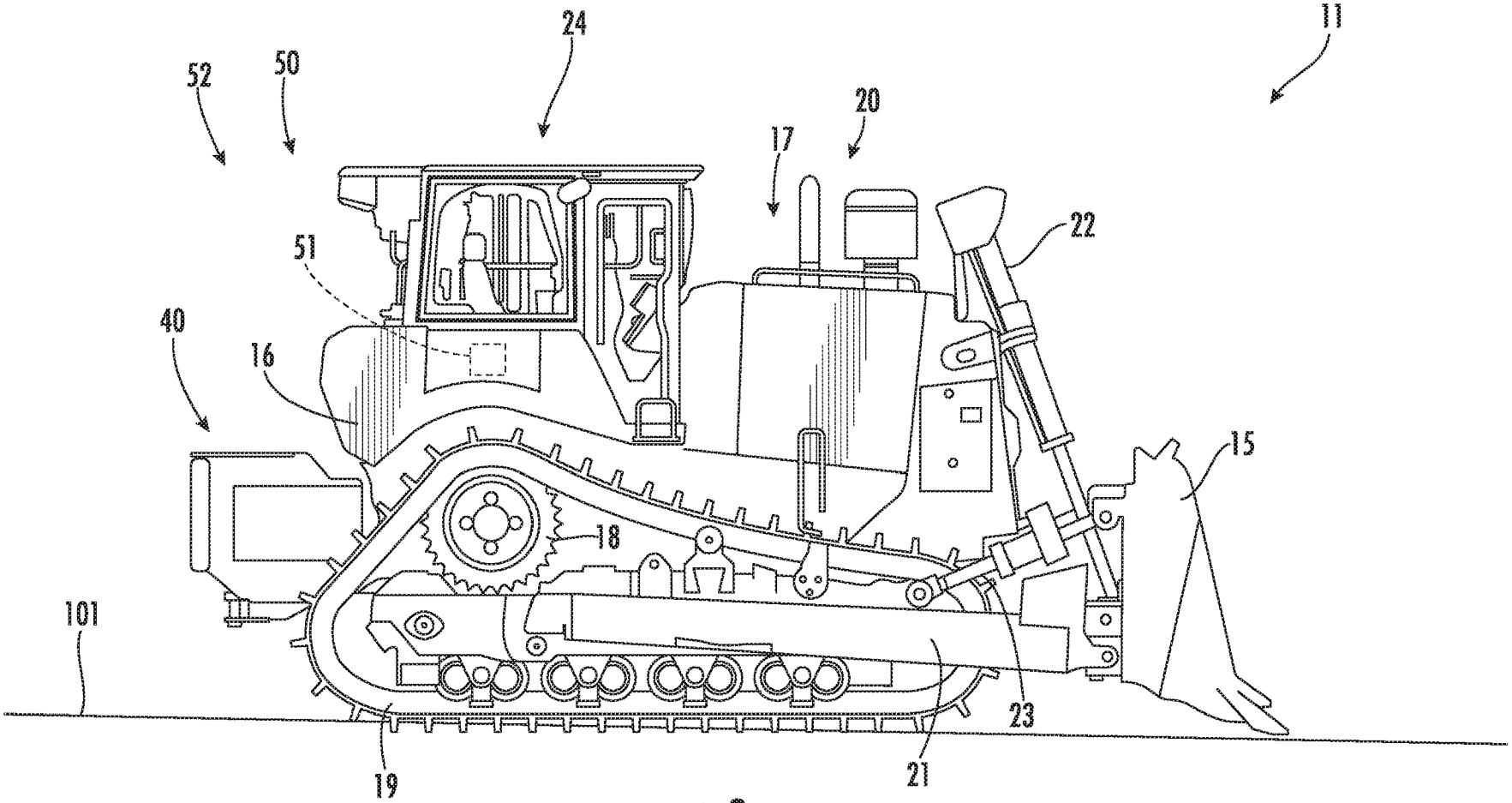
FIG. 2 depicts a diagrammatic illustration of a machine in accordance with the disclosure.

FIG. 2 depicts a diagrammatic illustration of a machine 10 such as a dozer 11 with a ground-engaging work implement such as a blade 15 configured to push material. The dozer 11 includes a frame 16 and a prime mover such as an engine 17. A ground-engaging drive mechanism such as a track 19 may be operatively coupled to the prime mover, through a drive sprocket 18 on opposite sides of the dozer 11, to propel the machine.

The dozer 11 may include a drivetrain 20 operatively connected to the engine 17 to drive the drive sprockets 18 and the tracks 19. The systems and methods of the disclosure may be used with any type of machine propulsion and drivetrain mechanisms applicable in the art for causing movement of the dozer 11 including hydrostatic, electric or mechanical drives. Further, although dozer 11 is shown in a "track-type" configuration, other configurations, such as a wheeled configuration, may be used.

The blade 15 may be pivotally connected to frame 16 by arms 21 on each side of the dozer 11. First hydraulic cylinder 22 coupled to frame 16 supports blade 15 in the vertical direction and allows the blade to move up or down vertically from the point of view of FIG. 2. A second hydraulic cylinder 23 on each side of the dozer 11 allows the pitch angle of blade tip to change relative to a centerline of the machine.

Dozer 11 may include a cab 24 that an operator may physically occupy and provide input to control the machine. Cab 24 may include one or more input devices such as a joystick 25 (FIG. 6) through which the operator may issue operating commands to control the propulsion system and steering system of the machine as well as operate various implements associated with the machine.

Figure 3:
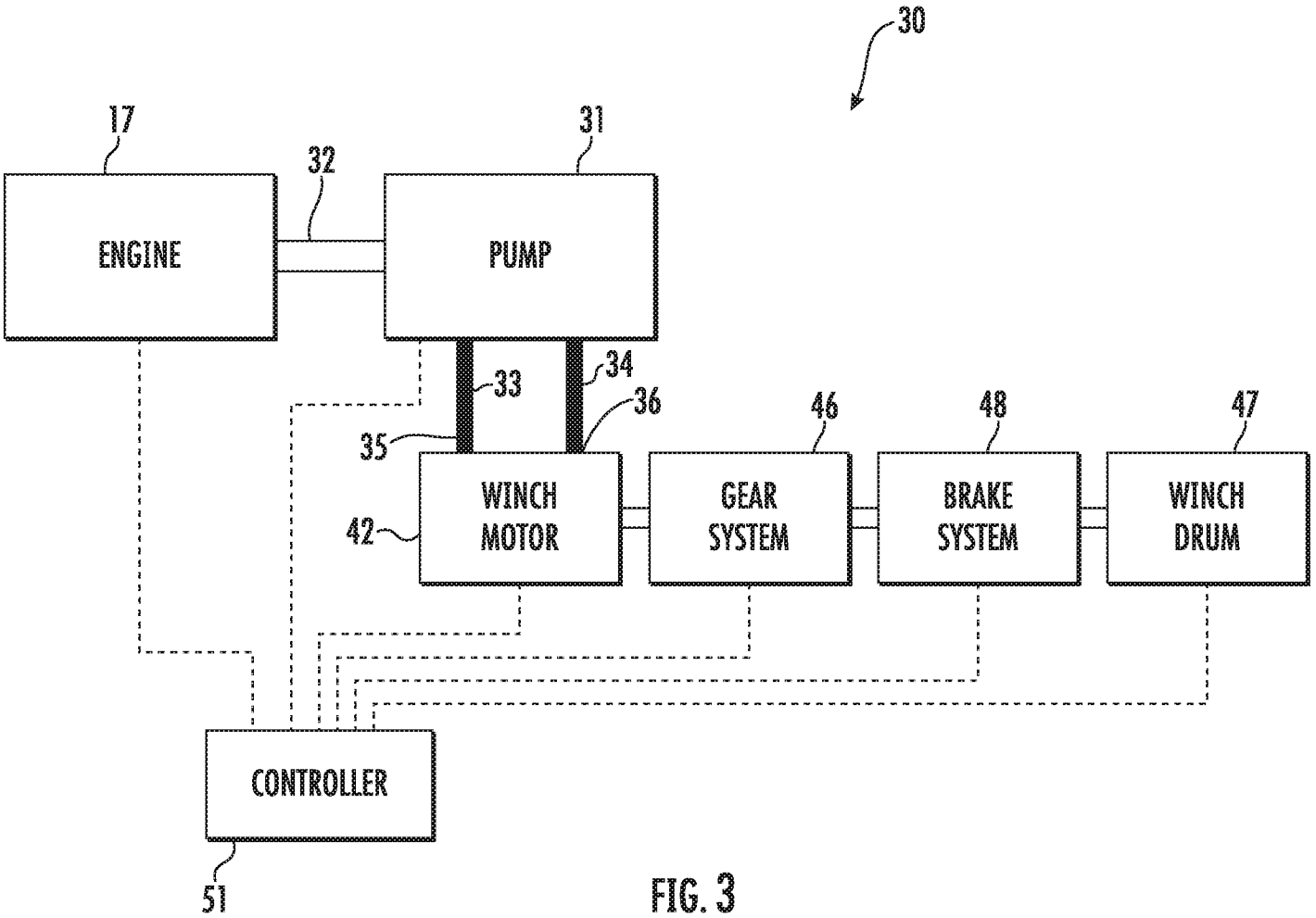
FIG. 3 depicts a block diagram of a first embodiment of a portion of an engine, a hydraulic drive system, and a winch assembly of the machine of FIG. 2.

The dozer 11 may include a hydraulically driven winch assembly 40 that operates to reel in and reel out the winch cable 41. Referring to FIG. 3, a first embodiment is depicted utilizing a "closed loop" hydraulic drive system 30 to drive a hydraulic winch motor 42. In such system, the prime mover, such as engine 17, may drive, directly or indirectly, a pump 31 that is hydraulically connected to a hydraulic winch motor 42. As depicted, the engine 17 mechanically drives pump 31 through shaft 32. A hydraulic connection between the pump 31 and the hydraulic winch motor 42 is depicted as a first hydraulic line 33 and a second hydraulic line 34.

Although depicted as a closed loop hydraulic drive system 30 with the first hydraulic line 33 and the second hydraulic line 34 connecting the pump 31 to the hydraulic winch motor 42, other components or systems such as a cooling system (not shown) may be operatively connected to the first hydraulic line 33 and/or the second hydraulic line 34. Further, although depicted with the engine 17 driving a single pump 31, the dozer 11 may include one or more pumps that are each driven by the engine 17 such as with the shaft of a first pump coupled to a drive shaft of the engine and each subsequent pump being coupled to the shaft of an adjacent pump.

The pump 31 may be configured as a variable displacement hydraulic pump with a swashplate (not shown) capable of over-center rotation so that the direction of flow through the pump may be reversed. By controlling the displacement of the pump 31, the amount of flow of hydraulic fluid through the first hydraulic line 33 and the second hydraulic line 34 to the hydraulic winch motor 42 may be controlled.

Figure 4:
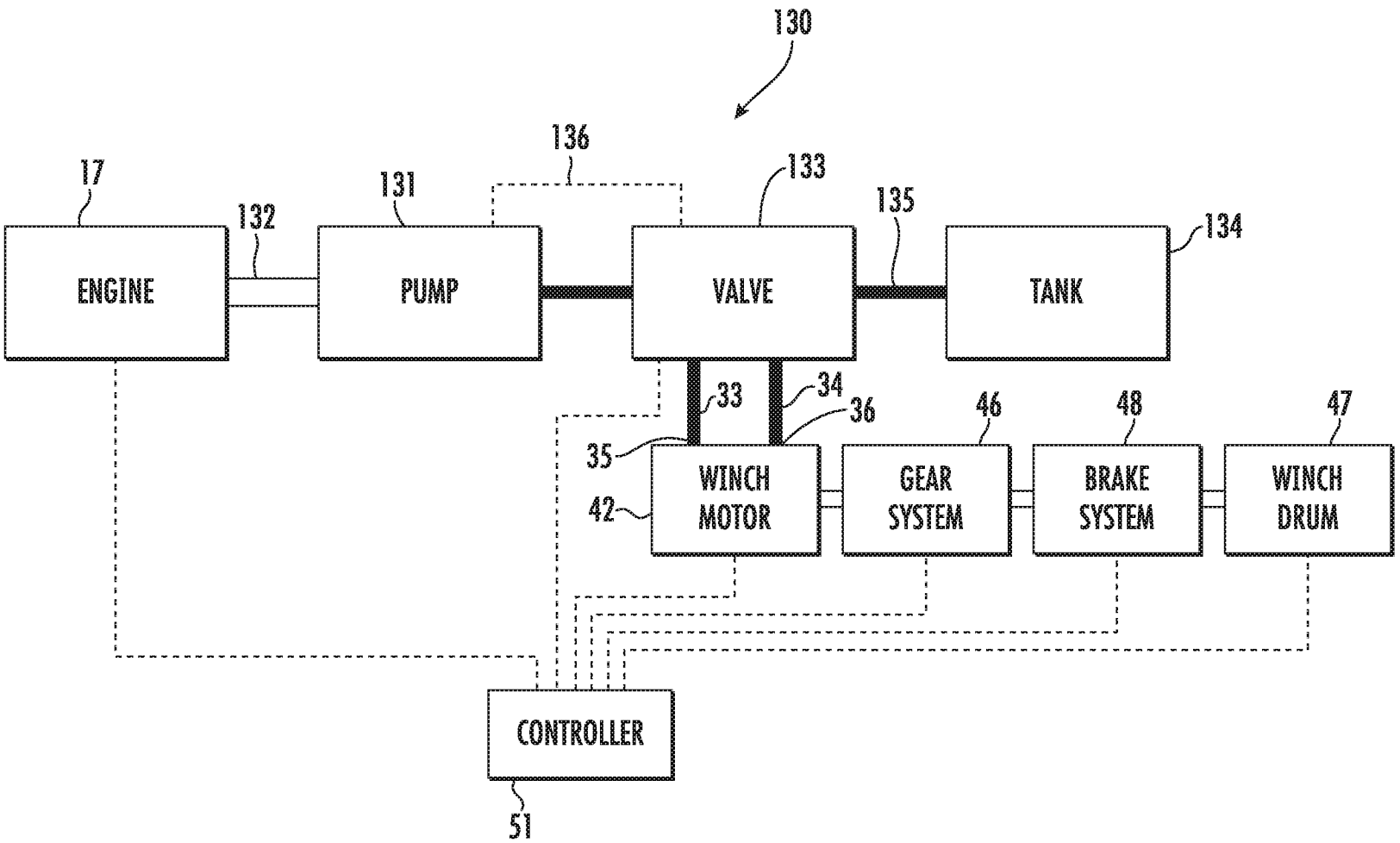
FIG. 4 depicts a block diagram of a second embodiment of a portion of an engine, a hydraulic drive system, and a winch assembly of the machine of FIG. 2.

A second embodiment is depicted in FIG. 4 in which an "open loop" hydraulic drive system 130 is operative to drive the hydraulic winch motor 42. In such system, the prime mover, such as engine 17, may mechanically drive a pump 131 through a shaft 132. The pump 131 is operatively connected to a manifold (not shown) from which hydraulic fluid is distributed. Flow of pressurized hydraulic fluid from the pump 131 through the manifold to various systems of the dozer 11 may be controlled by a plurality of valves, with one such valve being depicted at 133 in FIG. 4.

Valve 133 is operative to control the flow of hydraulic fluid to the hydraulic winch motor 42 and, more specifically, may control the amount and direction of fluid flow to the hydraulic winch motor through a first hydraulic line 33 and a second hydraulic line 34. The valve 133 may be configured as an electrically controlled, proportional valve movable between three operative states. At the state, no hydraulic fluid flows through the valve 133 to the hydraulic winch motor 42. At the second state, hydraulic fluid flows through the valve 133 to the first hydraulic line 33 connected to the hydraulic winch motor 42 and flows out of the hydraulic winch motor through the second hydraulic line 34, back through the valve, and to the tank 134 through tank line 135. At the third state, hydraulic fluid flows through the valve 133 to the second hydraulic line 34 connected to the hydraulic winch motor 42 and flows out of the hydraulic winch motor through the first hydraulic line 33, back through the valve, and to the tank 134 through tank line 135. At each of the second and third states, the valve 133 is movable through a plurality of positions at which flow is permitted through the valve 133 to the first port 35 and the second port 36, respectively. The valve 133 may be configured so that the amount of flow of hydraulic fluid through the valve 133 depends upon the extent of displacement of the valve at each of the second and third states.

The pump 131 may be configured as a fixed displacement pump or a variable displacement hydraulic pump. A feedback or sensing hydraulic line 136 may be provided between the pump 131 and the valve 133 to control the operation of the pump. The amount of flow of hydraulic fluid through the first hydraulic line 33 and the second hydraulic line 34 to the hydraulic winch motor 42 may be controlled by controlling the position of the valve 133.

Other configurations of hydraulic systems for driving the hydraulic winch motor 42 are contemplated.

The hydraulic winch motor 42 may have any desired configuration. In embodiments, the hydraulic winch motor 42 may be a variable displacement motor. In other embodiments, the hydraulic winch motor 42 may be a fixed displacement motor. In some embodiments, when the hydraulic winch motor 42 is configured as a variable displacement motor, it may be desirable to control the displacement of the motor to control the speed of the pump 31 relative to the speed of the hydraulic winch motor to optimize torque versus speed of the winch assembly 40.

The hydraulic winch motor 42 includes a first port 35 hydraulically connected to the first hydraulic line 33 and a second port 36 hydraulically connected to the second hydraulic line 34. The direction of rotation of the hydraulic winch motor 42 depends upon whether hydraulic fluid is flowing into the first port 35 or the second port 36. More specifically, flow into the hydraulic winch motor 42 from the first hydraulic line 33 through the first port 35 and out of the second port 36 will cause the winch motor to rotate in a first direction while flow into the winch motor through the second port and out of the first port will cause the winch motor to rotate in a second, opposite direction. As stated above, the direction and rate of flow of hydraulic fluid into the hydraulic winch motor 42 may be controlled by controlling the swashplate (not shown) of pump 31 or by controlling the position of valve 133, respectively.

In one embodiment, increasing the pressure at the first port 35 to provide fluid flow from the first port to the second port 36 will cause a length of winch cable 41 to be reeled out. Conversely, increasing the pressure at the second port 36 to provide fluid flow from the second port to the first port 35 will cause a length of winch cable 41 to be reeled in. The first port 35 may thus be referred to as the reel-out port and the second port may be referred to as the reel-in port.

A rotatable winch drum 47 may be operatively connected to the hydraulic winch motor 42 by a gear system 46 that is operatively connected to the winch motor. In embodiments, the gear system 46 may be configured to provide a plurality of rotations of the winch motor 42 for each rotation of the winch drum 47. Rotation of the winch drum 47 may be prevented by a brake system 48 operatively connected thereto. The gear system 46 and the brake system 48 may have any desired configuration. In embodiments, the gear system 46 and the brake system 48 may be configured with a default condition in which rotation of the winch drum 47 is prevented (i.e., the brake applied) unless the brake system is disengaged. The winch drum 47 may be configured with the winch cable 41 wrapped around it a plurality of times. The number of times that the winch cable 41 is wrapped around the winch drum 47 may be a function of the size (i.e., the diameter and width of the drum) as well as the length and diameter of the winch cable. Other configurations of the winch assembly 40 are contemplated.

The operation of the engine 13, pump 31, winch assembly 40, valve 133, and other systems and components of the dozer 11 may be controlled by a control system 50 as shown generally by an arrow in FIG. 2 indicating association with the machine. The control system 50 may include an electronic control module or controller 51 and a plurality of sensors. The controller 51 may receive input signals from an operator operating the dozer 11 from within the cab 24 or off-board the machine through a wireless communications system. The controller 51 may control the operation of various aspects of the dozer 11 including the drivetrain 20, hydraulic systems, and the winch assembly 40.

The controller 51 may be an electronic controller that operates in a logical fashion to perform operations, execute control algorithms, store and retrieve data and other desired operations. The controller 51 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller 51 such as power supply circuitry, signal conditioning circuitry, driver circuitry, and other types of circuitry.

The controller 51 may be a single controller or may include more than one controller disposed to control various functions and/or features of the dozer 11. The term "controller" is meant to be used in its broadest sense to include one or more controllers and/or microprocessors that may be associated with the dozer 11 and that may cooperate in controlling various functions and operations of the machine. The functionality of the controller 51 may be implemented in hardware and/or software without regard to the functionality. The controller 51 may rely on one or more data maps relating to the operating conditions and the operating environment of the dozer 11 and the work site 100 that may be stored in the memory of controller. Each of these data maps may include a collection of data in the form of tables, graphs, and/or equations.

The control system 50 and the controller 51 may be located on the dozer 11 and may also include components located remotely from the machine. The functionality of control system 50 may be distributed so that certain functions are performed at dozer 11 and other functions are performed remotely.

Figure 5:
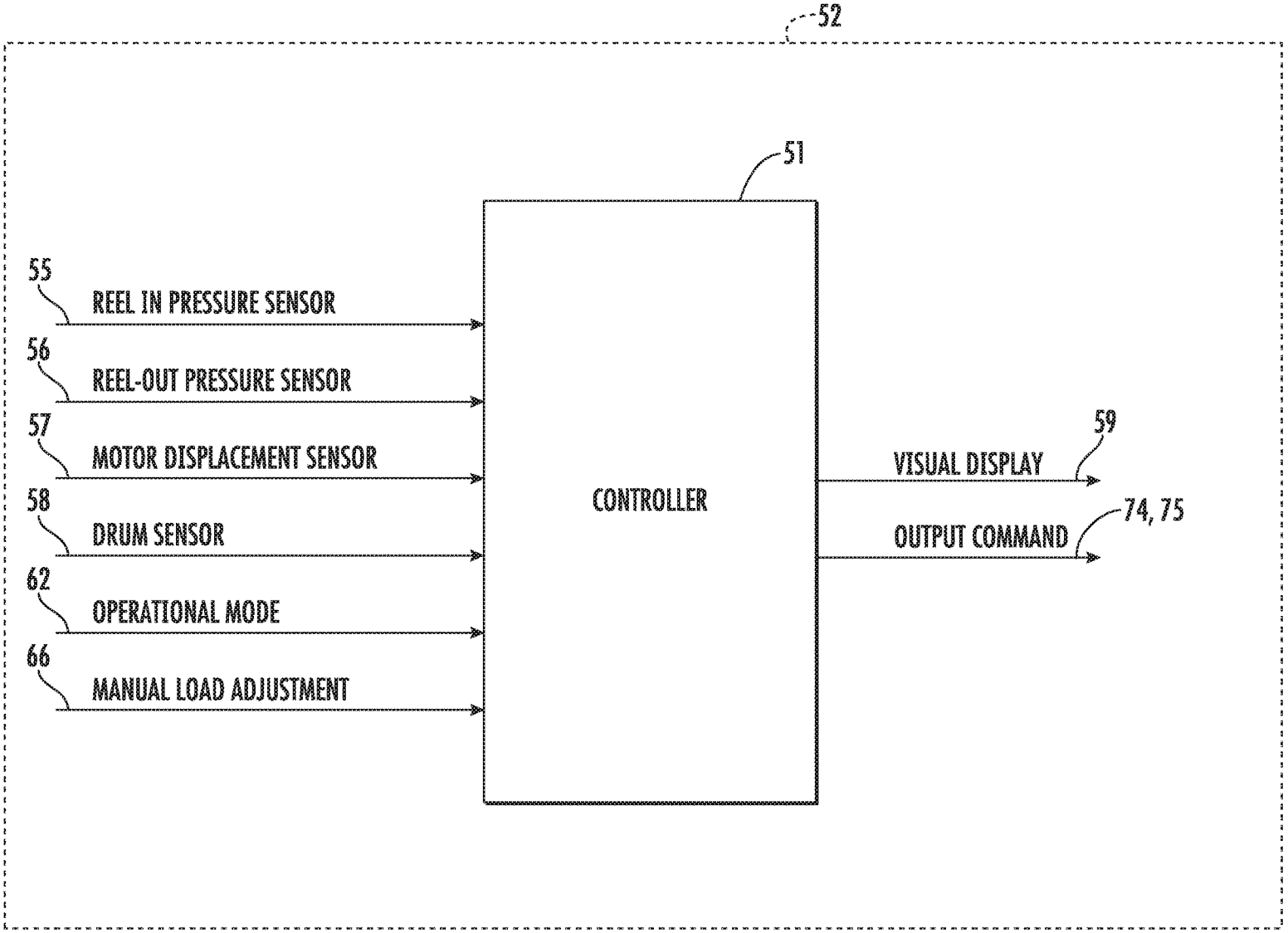
FIG. 5 depicts a block diagram of a portion of the control system of the machine of FIG. 2.

Referring to FIG. 5, dozer 11 may be equipped with a plurality of machine sensors that provide data indicative (directly or indirectly) of various operating parameters of the machine, or operating characteristics of certain components such as the winch motor 42, and/or the operating environment in which the machine is operating. The term "sensor" is meant to be used in its broadest sense to include one or more sensors and related components that may be associated with the dozer 11 and that may cooperate to sense various functions, operations, and operating characteristics of the machine and/or aspects of the environment in which the machine is operating.

A first pressure sensor 55 may be provided to sense or determine the pressure at the first port 35 or along the first hydraulic line 33 and provide pressure data indicative of the pressure. The first pressure sensor 55 may be provided at the first port 35 or spaced from the first port at another location along the first hydraulic line 33. A second pressure sensor 56 may be provided to sense or determine the pressure at the second port 36 or along the second hydraulic line 34 and provide pressure data indicative of the pressure. The second pressure sensor 56 may be provided at the second port 36 or spaced from the second port at another location along the second hydraulic line 34. Inasmuch as the first port 35 is sometimes referred to as the reel-out port, the first pressure sensor 55 may sometimes be referred to as the reel-out pressure sensor. Similarly, the second pressure sensor 56 may sometimes be referred to as the reel-in pressure sensor Data from the first pressure sensor 55 and data from the second pressure sensor 56 may be compared to determine the pressure differential between the first and second ports 35, 36. The first and second pressure sensors 55, 56 thus operate together as a pressure differential sensor and thus the data from the first and second pressure sensors or the result of the comparison of the data may be referred to as pressure differential data. Further, other manners of determining the pressure differential are contemplated.

In embodiments in which the hydraulic winch motor 42 is a variable displacement motor, a hydraulic winch motor displacement sensor 57 may be provided to sense the displacement of the hydraulic winch motor and provide displacement data indicative of the motor displacement to the controller 51. The hydraulic winch motor displacement sensor 57 may have any desired configuration. In other embodiments, rather than sensing the displacement of the hydraulic winch motor 42, the displacement may be determined based upon winch motor displacement commands (i.e., the current) used to control the displacement of the winch motor. Accordingly, in some embodiments, the input from winch motor displacement sensor 57 depicted in FIG. 5 may be replaced by the winch motor displacement commands or current used to control the displacement of the hydraulic winch motor 42.

Inasmuch as the torque provided by the hydraulic winch motor 42 is a function of the pressure differential between the first port 35 and the second port 36 of the winch motor and the displacement of the hydraulic winch motor, the first pressure sensor 55, the second pressure sensor 56, and the hydraulic winch motor displacement sensor 57 may define a torque sensor. In other instances, the displacement of the hydraulic winch motor 42 may be commanded by controller 51 rather than sensed by hydraulic winch motor displacement sensor 57. In such case, the torque may be determined based upon the pressure differential between the first and second ports 35, 36 of the winch motor and the displacement of the hydraulic winch motor, with the pressure differential determined by the first pressure sensor 55, the second pressure sensor 56, and the hydraulic winch motor displacement determined based upon displacement commands provided to the hydraulic winch motor 42.

A rotation sensor 58 may be provided for sensing, directly or indirectly, the rotational position of the winch drum 47 and for providing rotation data indicative of the rotational position. The rotation sensor 58 may have any desired configuration such as a rotary encoder mounted on or adjacent either the winch motor 42 or the winch drum 47. In some instances, it may be desirable to monitor the position of the winch motor 42 rather than the winch drum 47 since the winch assembly 40 may be configured such that the winch motor rotates a plurality of times for each rotation of the winch drum. The controller 51 may monitor and store rotational data of the winch motor 42 (or winch drum 47) to determine the angular position and the number of rotations of the winch drum 47. In an embodiment, a reference position of zero may correspond to the winch cable 41 being fully retracted.

Each of the first pressure sensor 55, the second pressure sensor 56, and the hydraulic winch motor displacement sensor 57 may be characterized as motor operating characteristic sensors as they generate operating characteristic data or signals indicative of an operating characteristic of the winch motor 42. The first pressure sensor 55, the second pressure sensor 56, the hydraulic winch motor displacement sensor 57, and the rotation sensor 58 may be characterized as winch operating characteristic sensors as they generate operating characteristic data or signals indicative of an operating characteristic of the winch assembly 40.

The control system 50 may include a winch control system 52 shown generally by an arrow in FIG. 2 indicating association with the machine 10. The winch control system 52 may operate to control the operation of the winch assembly 40. The winch assembly 40 may be configured to operate in a plurality of different operating modes. In a first operating mode, often referred to as a "free spool" mode, the winch drum 47 is disconnected from the remainder of the winch assembly 40 such as by releasing the brake system 48 or a portion of the brake system, and also the gear system 46 or a portion of the gear system. By disconnecting the winch drum 47 from the remainder of the winch assembly 40, the winch drum may be turned, such as to pull or reel out a length of winch cable 41, with very little force, such as approximately 50-100 pounds. In an embodiment, the winch control system 52 may be placed in the free spool mode by pulling the joystick 25 backwards or towards the operator in the cab 24.

In a second operating mode, often referred to as "brake-off" mode, the winch drum 47 remains connected to the gear system 46 but the gear system is not connected to the winch motor 42. As a result, the winch drum 47 is still capable of turning but such turning is resisted by the internal resistance of the gear system. In an example, the force required to pull out a length of winch cable 41 when operating in brake-off mode may be approximately 1,000-2000 pounds. In an embodiment, the winch control system 52 may be placed in the brake-off mode by pushing the joystick 25 forwards or away from the operator.

A third operating mode may be referred to as a "brake-on" mode in which the brake system 48 is engaged so that rotation of the winch drum 47 is prevented and the winch cable 41 remains stationary relative to the winch drum. In an embodiment, the winch control system 52 may be placed in the brake-on mode by allowing the joystick 25 to return to or maintaining the joystick in its centered or default position, or by giving a "reel-in" or "reel-out" command as described below.

A fourth operating mode may be referred to as a "reel-out" mode in which the winch motor 42 is rotated to feed or reel out the winch cable 41. A fifth operating mode may be referred to as a "reel-in" mode in which the winch motor 42 is rotated to reel in the winch cable 41. In an embodiment, the winch control system 52 may be placed in the reel-in mode by pulling the joystick 25 inward laterally and may be placed in the reel-out mode by pushing the joystick 25 outward laterally. The rate at which the winch cable 41 is reeled out or reeled in may be proportional to the amount of displacement of the joystick 25.

In a sixth operating mode, referred to as an "auto-tension" mode, the winch control system 52 may operate to prevent the winch cable 41 from being reeled-out or reeled-in while operating within a specified range or zone. To do so, a desired winch load may be entered into, set within or accessed by the winch control system 52 in any desired manner. In one example, an operator may specify a desired winch load numerically (e.g., 50,000 lbs) through an input device. In another example, an operator may specify a desired winch load based upon a relative scale (e.g., 1-100) with respect to the overall capacity of the winch assembly 40.

Based upon the desired winch load, the winch control system 52 may determine the torque necessary to generate and maintain such a load. Through the use of look-up or data tables stored within or accessed by the controller 51, the winch control system 52 may determine the pressure differential between the first port 35 and the second port 36 of the hydraulic winch motor 42 required to generate the desired torque based upon the displacement of the winch motor, the geometry of the winch drum 47, and the location of the winch cable 41 relative to the winch drum. In other words, to supply the desired force on the winch cable 41, the winch motor 42 must generate a desired torque in view of the size of the winch drum 47 and the distance of the winch cable 41 from the center of rotation of the drum. The distance of the winch cable 41 from the center of rotation of the winch drum 47 may be determined based upon the known characteristics of the winch drum and the angular or rotational position of the winch drum as determined from rotational signals or data supplied by the rotation sensor 58. Based upon the displacement of the winch motor 42 as determined from the displacement signals from the displacement sensor 57, the winch control system 52 may determine the pressure differential necessary to generate the required torque.

After a desired winch load has been set within the winch control system 52 when using the auto-tension mode, an operator may further or subsequently adjust the desired winch load or tension on the winch cable 41. This may be desirable in instances in which the desired winch load is set generally and then is more finely adjusted and/or in instances in which operating conditions change.

Figure 6:
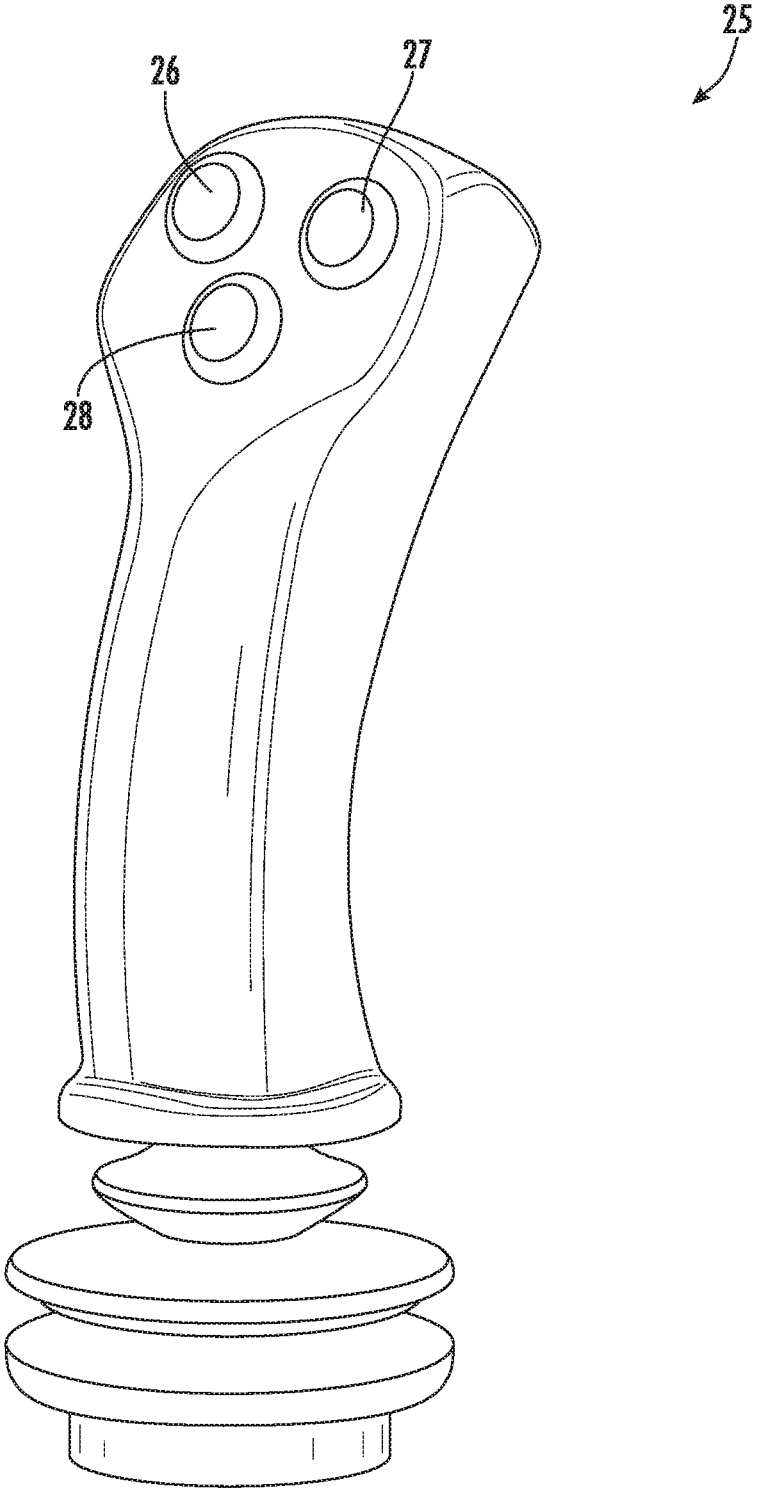
FIG. 6 depicts a diagrammatic illustration of a joystick in accordance with the disclosure.

As an example, an operator may generally set an initial desired winch load (either numerically or on a relative scale), and then increase or decrease the load through an input device. Referring to FIG. 6, the joystick 25 may include three input buttons 26-28. The first input button 26 may operate to enable or turn on and off the auto-tension mode. The second input button 27 may operate to increase the desired winch load and the third input button 28 may operate to decrease the desired winch load. In other embodiments, the second and third input buttons 26, 27 may be replaced by a rotational input device (not shown).

As the dozer 11 and a machine 10 such as the excavator 12 tethered to the winch cable 41 operate, changes in the tension on the cable may occur. Increases in tension on the winch cable 41 may pass the upper winch load limit resulting in a length of winch cable being pulled or reeled out of the winch assembly 40. Decreases in tension on the winch cable 41 may result in the tension in winch cable 41 being less than the lower winch load limit resulting in a length of winch cable being retracted or reeled into the winch assembly 40.

Other modes of operation are contemplated as are other manners of moving the joystick 25 to initiate, operate, or terminate each operating mode. Further, all winch assemblies may not include or be configured with all of the operating modes described above.

Figure 7:
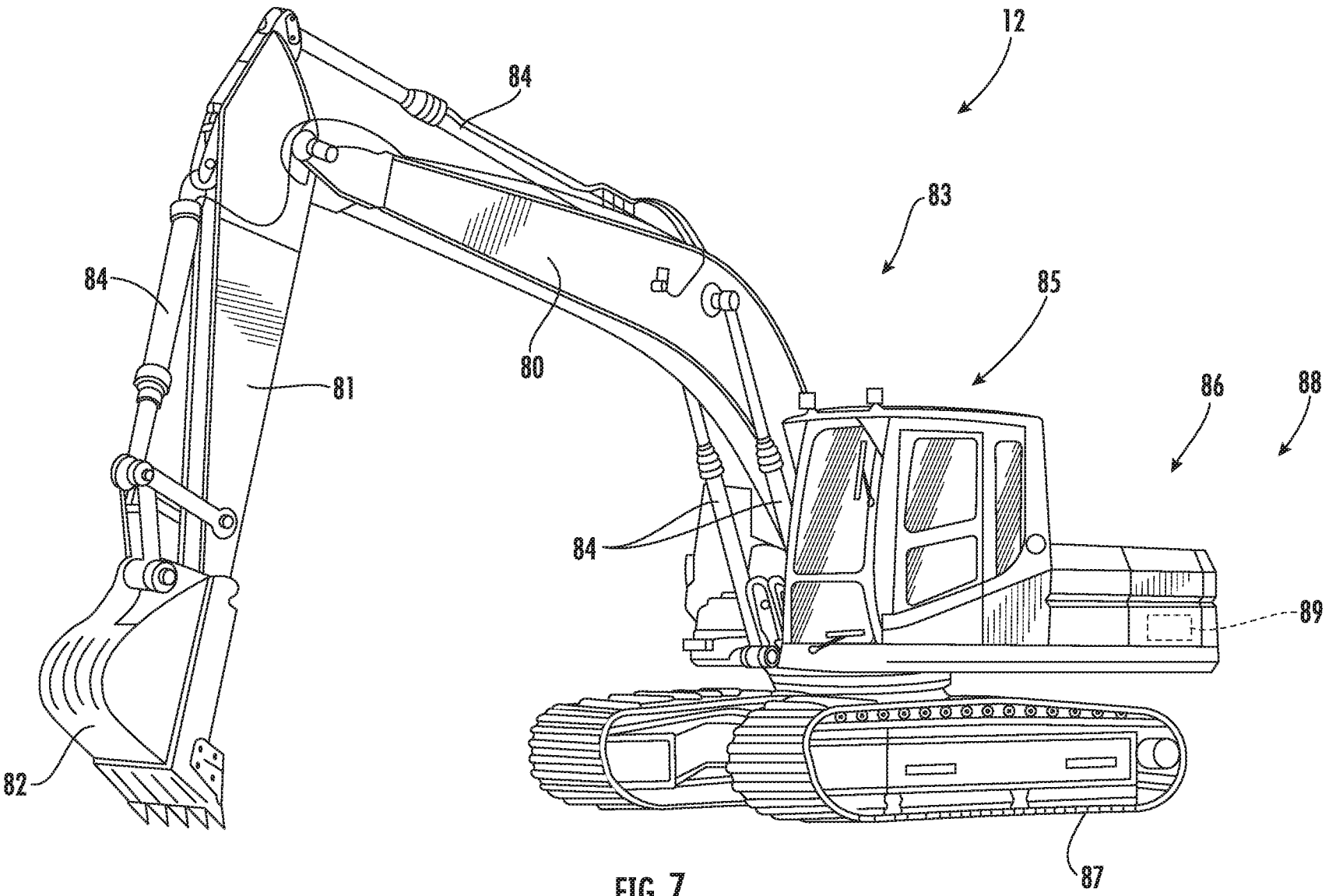
FIG. 7 depicts a diagrammatic illustration of a second machine in accordance with the disclosure.

Referring to FIG. 7, an exemplary machine 10 that may be tethered to a dozer 11 is depicted. The excavator 12 may include an implement system having a boom member 80, a stick member 81, and a work implement 82. The work implement 82 may take any desired form including a bucket, a hydraulic hammer, or a grapple. The implement system may be operatively connected to a hydraulic system generally indicated at 83 including hydraulic cylinders or actuators 84 for causing movement of the implement system. An operator may operate the excavator 12 from an operator station or cab 85. A prime mover 86 is operatively connected to and drives a ground engaging drive mechanism such as tracks 87. The excavator 12 may include a control system 88 and a controller 89 identical or similar to the control system 50 and controller 51 described above and the descriptions thereof are not repeated.

Although depicted with the winch cable 41 extending between a dozer 11 and an excavator 12, the winch assembly 40 may be mounted on any type of machine and may be used for any type of winching operation. For example, the winch assembly 40 may be used to transport any type of equipment such as a pipelayer, a welding rig, or a personnel transport up and down a slope at a work site 100.

INDUSTRIAL APPLICABILITY

The industrial applicability of the winch assembly 40 described herein will be readily appreciated from the foregoing discussion. The foregoing discussion is applicable to systems that use a winch assembly 40 in which it is desirable to perform various winching operations including maintaining a range of winch loads on the winch cable 41 without applying or engaging the brake system 48 of the winch assembly. Such winch assembly 40 may be used at a mining site, a landfill, a quarry, a construction site, a roadwork site, a forest, a farm, or any other area in which the use of winch assemblies is desired.

The winch control system 52 may be used to control the operation of the winch assembly 40 such as by controlling the operating modes identified above. In some instances, it may be desirable to use the auto-tension mode rather than using a combination of brake-on, brake-off, and other operating modes. For example, referring back to FIG. 1, three dozers 11 are interconnected by winch cables 41 and support an excavator 12 that is operating on a steeply sloped work surface 101. In such a configuration, the upper two dozers 11 (i.e., farthest to the left in FIG. 1) may typically operate as "anchors" to support the lower dozer 11 (i.e., closest to the excavator 12) and the excavator. As anchors, the upper two dozers 11 may be parked with their service brakes on and with their winch assemblies in a brake-on mode.

In order to simplify or improve the operation of the excavator 12, the winch assembly 40 of the lower dozer 11 may be operated in the auto-tension mode with the desired winch load set at a level that is sufficient to support the excavator 12. The desired winch load may depend upon the size of the excavator 12 as well as the operating conditions and slope of the work surface 101. In one example, the upper limit of the desired winch load may be set at 20,000 pounds while the lower limit may be set at 2,000 pounds. In another example, the upper desired winch load may be set at 50,000 pounds and the lower limit set at 1,000 pounds. Other desired winch loads or limits may be set as desired. Further, in some embodiments, only an upper or lower limit may be set.

The tension on the winch cable 41*a* extending between the lower dozer 11 and the excavator 12 operates to provide support to the excavator while allowing it to perform desired operations without limiting its ability to move along the work surface 101. By using the auto-tension mode, an operator of the excavator 12 may readily perform normal or typical operations along the sloped work surface 101.

Figure 8:
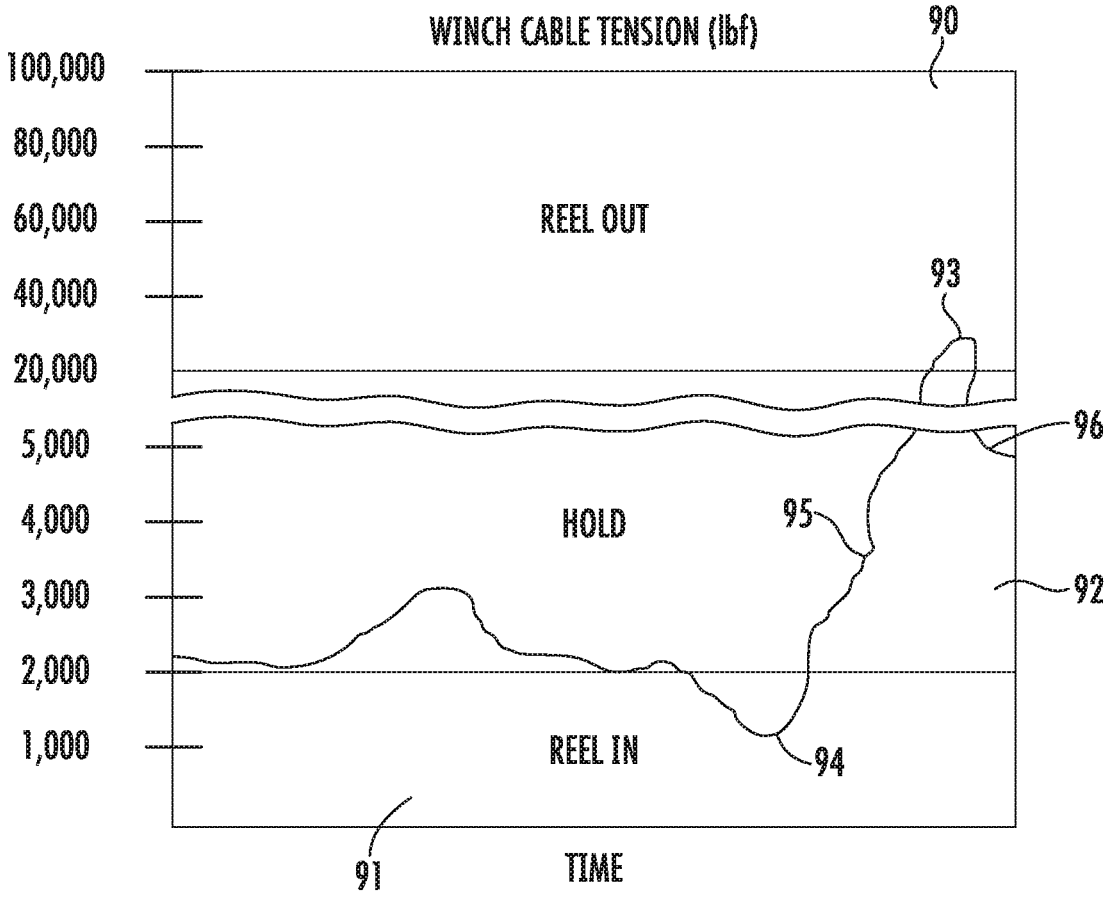
FIG. 8 depicts an exemplary graph of cable load as a function of time.

Referring to FIG. 8, an exemplary graph is depicted in which the load on the winch cable 41 is depicted as function of time. An upper limit of the desired winch load is set at 20,000 pounds and a lower limit is set at 2,000 pounds. Such a configuration defines an upper reel zone 90, a lower reel zone 91, and a hold zone 92. In the depicted example, if the tension on the winch cable 41 is greater than 20,000 pounds, the winch cable will be reeled or fed out until the force or load on the winch cable is less than the upper limit. If the tension on the winch cable 41 is less than 2,000 pounds, the winch cable will be reeled in until the force or load is greater than the lower limit. Further, if the tension on the winch cable 41 is between 2,000 and 20,000 pounds, the winch cable will not be reeled out or reeled in.

In order to determine whether the winch assembly is operating within the upper reel zone 90, the lower reel zone 91, or the hold zone 92, the load or tension on the winch cable 41 may be determined. The load or tension on the winch cable 41 is a function of the torque at the hydraulic winch motor 42 and the distance of the winch cable 41 from the center of rotation of the winch drum 47. The torque at the hydraulic winch motor 42 is a function of the pressure differential between the pressure at the first port 35 and the pressure at the second port 36 as well as the displacement of the hydraulic winch motor 42.

In an embodiment, for each combination of pressure differential between the first port 35 and the second port 36 of the hydraulic winch motor 42, as well as the displacement of the hydraulic winch motor 42, and each possible rotational position of the winch drum 47, the resulting load or tension on the winch cable 41 may be stored or set within the memory of the controller 51. In another embodiment, one or more formulas for determining the load or tension as a function of each combination of pressure differential between the first port 35 and the second port 36 of the hydraulic winch motor 42, the displacement of the hydraulic winch motor 42, and each possible rotational position of the winch drum 47 may be stored within the controller 51. Accordingly, in an embodiment, by determining the pressure differential between the first port 35 and the second port 36 of the hydraulic winch motor 42, the displacement of the hydraulic winch motor 42, and the rotational position of the winch drum 47, the load on the winch cable 41 may be determined. Further, upon determining the load on the winch cable 41, the controller 51 may determine whether the winch assembly 40 is operating within the upper reel zone 90, the lower reel zone 91, or the hold zone 92.

Further, although the load on the winch cable 41 may be determined based upon the pressure differential between the first port 35 and the second port 36 of the hydraulic winch motor 42, the displacement of the hydraulic winch motor, and the distance of the winch cable 41 from the center of rotation of the winch drum 47, in other embodiments, the load on the winch cable may be determined by a cable load sensor (not shown) on or associated with the winch cable. Such a cable load sensor may take any desired form and may be positioned at any location. In an example, a cable load sensor may be disposed on a portion of the cable or interact with the cable to generate signals indicative of the load on the winch cable 41.

Thus, as used herein, a cable load sensor may take many different forms to directly or indirectly measure the cable tension and generate tension data indicative of the tension on the winch cable. In one embodiment, the cable load sensor may be a sensor on or associated with the winch cable. In another embodiment, the cable load sensor may be a combination of the pressure differential sensor, the hydraulic winch motor displacement sensor 57, and the rotation sensor 58. In other embodiments, the hydraulic winch motor displacement sensor 57 may be omitted such as when using a fixed displacement motor and/or the rotation sensor 58 may be omitted such as when approximating the position of the winch cable 41 relative to the center of the winch drum 47.

During operation of the dozer 11 and/or the excavator 12, the load on the winch cable 41 may change. More specifically, in some instances, the dozer 11 and/or excavator 12 may be driven or propelled down the sloped work surface 101 or laterally (or in some instances upward) and/or operated in such a manner that increases the load or tension on the winch cable 41 so that it exceeds the upper load limit (e.g., 20,000 pounds). In other instances, the dozer 11 and/or excavator 12 may be driven or propelled up the sloped work surface 101 or laterally (or in some instances downward) and/or operated in such a manner that decreases the load or tension on the winch cable 41 so that it is less than the lower load limit (e.g., 2,000 pounds). In still other instances, the excavator 12 may be propelled and/or operated with the load on the winch cable 41 being within the hold zone 92 (i.e., with the load or tension on the winch cable 41 being greater than the lower load limit (e.g., 2,000 pounds) and less than the upper load limit (e.g., 20,000 pounds)).

For example, in some instances, the dozer 11 and/or excavator 12 may be propelled and/or operated with the load on the winch cable 41 being within the hold zone 92. In other words, the load or tension on the winch cable 41 is greater than the lower load limit (e.g., 2,000 pounds) and less than the upper load limits (e.g., 20,000 pounds). Upon determining that the winch assembly 40 is operating within the hold zone, flow of hydraulic fluid through the hydraulic winch motor 42 is prevented so that the winch drum 47 does not rotate. To do so, when utilizing the closed loop hydraulic drive system 30, the displacement of the pump 31 is maintained at zero. In other words, the controller 51 may generate pump commands to maintain the displacement of the pump 31 at zero even as the pump is driven by the engine 17.

To prevent hydraulic fluid from flowing through the valve 133 to the hydraulic winch motor 42 when utilizing the open loop hydraulic drive system 130, the valve 133 is positioned or disposed at its first or closed position. To position the valve 133 at the closed position, a zero flow command may be generated by the controller 51. While some valves may not require an actual command to position the valve at a zero flow condition or orientation, as used herein, a zero flow command refers to an affirmative command to direct the valve 133 to such position or the lack of a command to move the valve to another position at which flow is directed through the valve.

The absence of fluid flow from the pump 31 or through the valve 133 will effectively close the first hydraulic line 33 and the second hydraulic line 34 and thus prevent the hydraulic winch motor 42 from rotating. Since the hydraulic winch motor 42 and the winch drum 47 are operatively connected, the winch drum 47 and the winch cable 41 are also held in place. In other words, referring to FIG. 8, as the tension on the winch cable 41 increases from the lower load limit towards a midpoint depicted at 95 between the lower load limit and the upper load limit (which will cause an increase in the pressure differential between the first port 35 and the second port 36), rotation of the winch drum 47 will be resisted by the absence of fluid flow through the hydraulic winch motor 42. The closed nature of the first hydraulic line 33 and the second hydraulic line 34 will further resist rotation of the hydraulic winch motor 42 even as the load on the winch cable 41 increase.

A decrease in load on the winch cable 41 such as at 96 while operating in the hold zone 92 will similarly result in no hydraulic fluid flowing through the hydraulic winch motor 42 so that the winch drum 47 does not rotate. As described above, the pump 31 may be maintained at zero displacement when using a closed loop hydraulic drive system 30 and the valve 133 may be maintained at its closed position when using an open loop hydraulic drive system 130. Thus, in each instance while operating within the hold zone 92, the load or tension on the winch cable 41 is resisted by the absence of hydraulic fluid flow through the hydraulic winch motor 42 and thus prevents the cable from being reeled in or reeled out.

When operating in the upper reel zone 90, the controller 51 may generate a pressure differential command to cause the hydraulic winch motor 42 to rotate to reel out a length of the winch cable 41 until the load or tension on the winch cable decreases to the upper limit of the desired winch load. More specifically, the pressure differential command may control the operation of the pump 31 or the valve 133 so that a flow of hydraulic fluid is provided to the first port 35 of the hydraulic winch motor 42 to reduce the pressure differential between the first and second ports. First pressure data from the first pressure sensor 55 and second pressure data from the second pressure sensor 56 may be received and compared to determine the pressure differential between the first port 35 and the second port 36. Once the pressure differential has been reduced sufficiently so that the winch assembly 40 is operating within the hold zone 92, a zero flow command may be generated by the controller 51 to maintain the winch assembly in the hold zone.

Similarly, when operating in the lower reel zone 91, the controller 51 may generate a pressure differential command to cause the hydraulic winch motor 42 to rotate to reel in a length of the winch cable 41 until the load or tension on the winch cable increases to the lower limit of the desired winch load. More specifically, the pressure differential command may control the operation of the pump 31 or the valve 133 so that a flow of hydraulic fluid is provided to the second port 36 of the hydraulic winch motor 42 to increase the pressure differential between the ports. First pressure data from the first pressure sensor 55 and second pressure data from the second pressure sensor 56 may be received and compared to determine the pressure differential between the first port 35 and the second port 36. Once the pressure differential has been increased sufficiently so that the winch assembly 40 is operating within the hold zone 92, a zero flow command may be generated by the controller 51 to maintain the winch assembly in the hold zone.

It should be noted that as the winch cable 41 is fed out of the winch drum 47, the distance between the winch cable and the center of rotation of the winch drum may change. The change in distance between the winch cable 41 and the center of rotation of the winch drum 47 may be determined based upon rotational data from the rotation sensor 58. The winch control system 52 may adjust the pressure differential corresponding to each of the upper reel zone 90, the lower reel zone 91, and the hold zone 92 to compensate for changes in the distance to the center of rotation of the winch drum 47.

In some embodiments, it may be possible to improve the winch operation by using the auto-tension mode in place of some of the other operating modes described above. In addition or in the alternative, using the auto-tension mode in place of some of the other operating modes may permit cost reductions or improvements in the design or operation of the winch assembly 40. For example, as stated above, when operating in the brake-off mode, the winch drum 47 may be rotated upon the application of a load of approximately 1,000-2,000 pounds. This load is required when some or all of the clutches within the gear system 46 are not released so that the gear system remains connected to the winch drum 47. If desired, the winch control system 52 may be configured to provide a mode that imitates or approximates the brake-off mode by requiring a load on the winch cable 41 of approximately 1,000-2000 pounds before the cable may be pulled from the winch drum 47. In other instances, the auto-tension mode or a modification thereof may be used to imitate or approximate other operating modes. Further, a variation of the auto-tension mode may be used when applying or removing the brake to reduce any sudden changes in the load on the winch cable 41.

Figure 9:
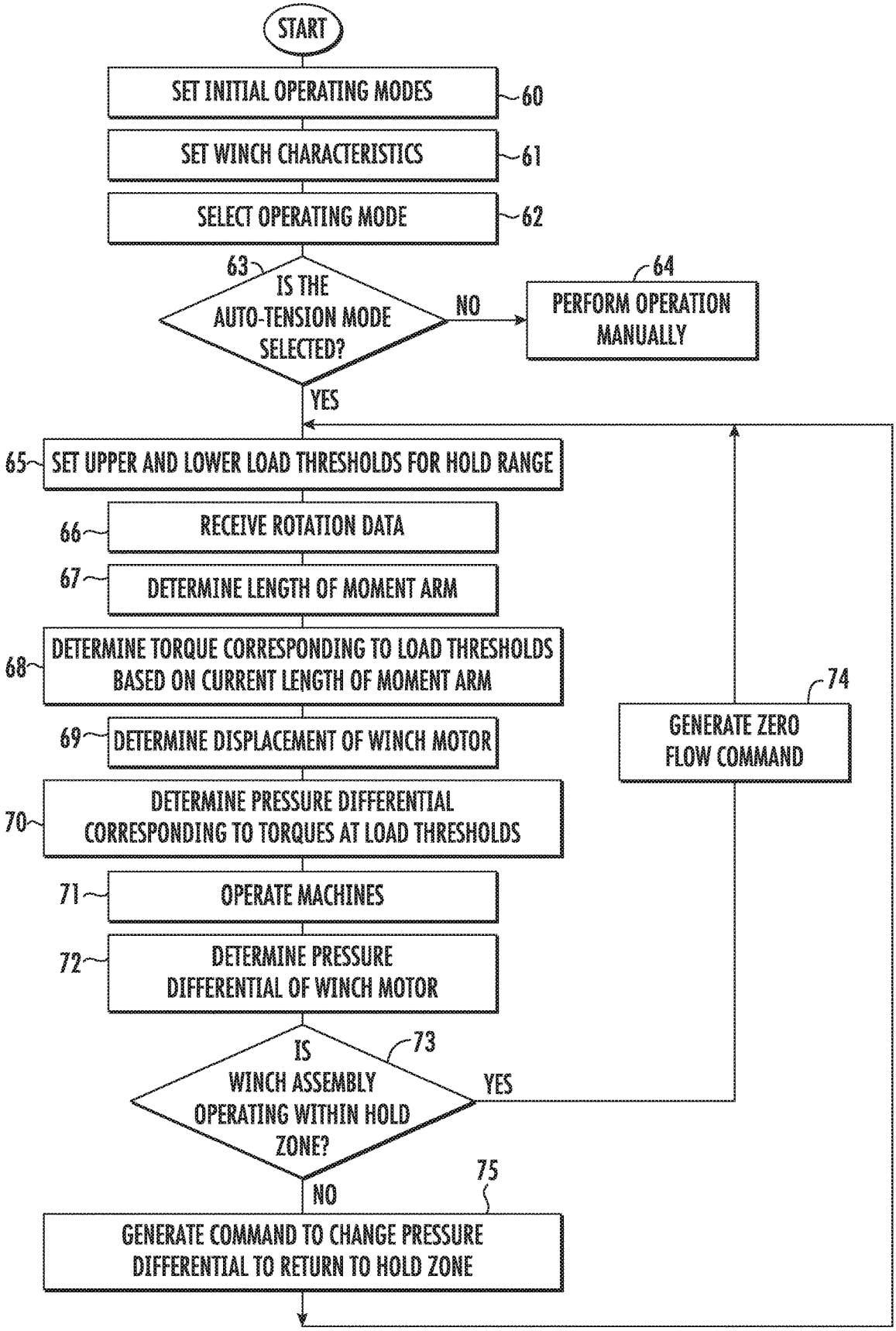
FIG. 9 depicts a flowchart illustrating the operation of the winch assembly in accordance with the disclosure.

The flowchart of FIG. 9 depicts the operation of the winch assembly 40 and includes details of the operation as the winch assembly operates in the auto-tension mode. At stage 60, a plurality of operating modes may be set or stored within the controller 51. The operating modes may correspond to any or all of the modes described above as well as any other desired operating modes. In addition, one or more desired winch loads thresholds or default settings may be set for use when operating in the auto-tension mode. For example, upon enabling the auto-tension mode, the winch control system 52 may be configured to use a default setting for the upper load threshold on the winch cable 41 (e.g., 20,000 pounds, 50,000 pounds, or any other desired value) and/or an default setting for the lower load threshold (e.g., 1,000 pounds, 2,000 pounds, or any other desired value). In some embodiments, a display signal 59 (FIG. 5) may be generated by the controller 51 to display the default setting on a display device within the cab 24, either as an absolute number or as a relative number or scale with respect to the overall capacity of the winch assembly 40.

Winch characteristics may be set or stored within the memory of the controller 51 at stage 61. The winch characteristics may include winch dimensional characteristics of the winch drum 47 such as the dimensions (e.g., diameter and axial width) and/or the distance of the winch cable 41 from the center of rotation of the winch drum for each winch rotational position. The distance of the winch cable 41 from the center of rotation of the winch drum may be set or stored within the controller 51 as a function of the absolute rotational position of the winch drum 47 (i.e., the position of the winch drum together with the number of rotations from the fully retracted position). In other instances, the distance from the center of rotation of the winch drum 47 may be approximated by using the average distance or some other value. In some instances, the actual distance may be used with the torque generated by the winch motor 42 to determine the load or tension on the winch cable 41. In still other instances, the load or tension on the winch cable 41 may be determined based upon the approximate distance of the winch cable 41 from the center of rotation or by using some other value.

Additional winch characteristics may include the torque at the hydraulic winch motor 42 corresponding to each possible combination of pressure differential between the first port 35 and the second port 36 of the hydraulic winch motor and each possible displacement of the hydraulic winch motor. Still further, the load or tension on the winch cable 41 may be stored or set within the memory of or associated with the controller 51 as function of each possible combination of pressure differential between the first port 35 and the second port 36 of the hydraulic winch motor 42, each possible displacement of the hydraulic winch motor, and each possible rotational position of the winch drum 47. If the distance from the center of rotation of the winch drum 47 is approximated, the load or tension on the winch cable 41 may be stored or set as a function of the center of rotation distance and the pressure differential between ports.

At stage 62, an operator may select the desired operating mode. The controller 51 may determine at decision stage 63 whether the operating mode selected by the operator is the auto-tension mode. If the operating mode selected by the operator is not the auto-tension mode, the winch control system 52 may permit manual operation of the winch assembly 40 at stage 64.

If the operating mode selected by the operator at decision stage 63 is the auto-tension mode, the winch control system 52 may begin to operate according to the auto-tension mode process. More specifically, an upper load threshold and/or a lower load threshold may be set or stored within the controller 51 at stage 65. In some embodiments, default thresholds may be set or stored in memory at stage 60. Further, in some embodiments, the upper load threshold and/or lower load threshold may be set or adjusted in other manners. For example, an operator of the dozer 11 may enter the type of machine or object attached to the winch cable 41 either according to its general type or model number or according to a unique identification number associated with that machine or object. In other instances, such information may be automatically sensed by a sensor associated with the winch control system 52. In addition, an operator may change the upper load threshold and/or lower load threshold as desired regardless of whether they were pre-set or stored at stage 60 or whether they were set or stored at stage 65.

At stage 66, the controller 51 may receive rotational data from the rotation sensor 58 and determine the rotational position of the winch drum 47 based upon rotational data provided by the rotation sensor. The controller 51 may determine at stage 67 the distance from the winch cable 41 extending from the winch drum 47 to the center of the winch drum based upon the rotational data. As described above, in some instances the controller 51 may utilize an average or some approximation for the moment arm relative to the winch cable 41 and the winch drum 47.

At stage 68, the controller 51 may determine the torque corresponding to each of the upper load threshold and the lower load threshold based upon the moment arm (the distance from the winch cable 41 extending from the winch drum 47 to the center of the winch drum) of the winch assembly 40.

The controller 51 may determine at stage 69 the displacement of the hydraulic winch motor 42 based upon the displacement data from the displacement sensor 57. In other instances, the displacement of the hydraulic winch motor 42 may be determined based upon the displacement commands or current provided to the hydraulic winch motor to control its displacement. Further, if the hydraulic winch motor 42 is fixed displacement motor, the displacement may be stored or set within the controller 51.

The controller 51 may determine at stage 70 the pressure differentials corresponding to the load at each of the upper load threshold and the lower load threshold based upon the torque corresponding to each of the thresholds as determined at stage 68, the distance of the winch cable 41 from the center rotation of the winch drum 47 as determined at stage 67, and the displacement of the hydraulic winch motor 42 as determined at stage 69

The dozer 11 and/or excavator 12 may be operated at stage 71. While doing so, the load on the winch cable 41 may change over time such as depicted in the exemplary graph of FIG. 8. At stage 72, the controller 51 may receive first pressure sensor data from the first pressure sensor 55 and second pressure sensor data from the second pressure sensor 56 and determine the pressure differential between the first port 35 and the second port 36 of the hydraulic winch motor 42.

At decision stage 73, the controller 51 may determine whether the winch assembly is operating within the hold zone 92. To do so, the controller 51 may compare the pressure differential determined at stage 72 to the pressure differentials corresponding to each of the upper load threshold and the lower load threshold determined at stage 70. If the measured pressure differential is less than the upper limit and higher than the lower limit, the winch assembly 40 is operating within the hold zone 92. In such case, the controller 51 may generate a zero flow command at stage 74 and the flow of hydraulic fluid to the hydraulic winch motor 42 is prevented. To do so, in a closed loop hydraulic drive system, the pump 31 is maintained at zero displacement and, in an open loop drive system 130, the valve 133 is maintained at its closed position. As a result of the absence of flow through the hydraulic winch motor 42, rotation of the hydraulic winch motor 42 (and thus the winch drum 47) is prevented.

The machines such as dozer 11 and excavator 12 may then continue to be operated as desired and stages 65-75 repeated.

However, if the winch assembly 40 is operating outside of the hold zone 92 at decision stage 73, the controller 51 may generate a pressure differential command that will result in a change in the pressure differential at the hydraulic winch motor 42 and a flow of hydraulic fluid so that the winch assembly 40 will return to the hold zone 92. More specifically, if the winch assembly 40 is operating in the upper reel zone 90, the controller 51 may generate a pressure differential command that controls the operation of the pump 31 or the valve 133 so that a flow of hydraulic fluid is provided to the first port 35 of the hydraulic winch motor 42 to reduce the pressure differential between the first port 35 and the second port 36. Similarly, when operating in the lower reel zone 91, the controller 51 may generate a pressure differential command that controls the operation of the pump 31 or the valve 133 so that a flow of hydraulic fluid is provided to the second port 36 of the hydraulic winch motor 42 to increase the pressure differential between the first port 35 and the second port 36.

The machines such as dozer 11 and excavator 12 may then continue to be operated as desired and stages 65-75 repeated.

It should be noted that at any time during operation in auto-tension mode, an operator may elect to operate the winch assembly 40 in manual mode by generating an appropriate command or moving the joystick 25 in a desired manner.

Further, the example of FIG. 9 may be modified when using a cable load sensor on the winch cable 41 rather than relying upon the pressure differential at the hydraulic winch motor 42, the displacement of the hydraulic winch motor, and the distance of the winch cable 41 from the center of rotation of the winch drum 47 to determine the load on the winch cable and thus whether the winch assembly is operating within the upper reel zone 90, the lower reel zone 91, or the hold zone 92.

It will be appreciated that the foregoing description provides examples of the disclosed system and technique. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for controlling an operation of a winch assembly, comprising:

a rotatable winch drum;

a winch cable wrapped around the rotatable winch drum;

a hydraulic winch motor operatively connected to the rotatable winch drum, the hydraulic winch motor including a first port and second port for receiving hydraulic fluid;

a cable tension sensor operatively associated with the winch cable and configured to generate tension data indicative of a tension on the winch cable, the cable tension sensor comprising a pressure differential sensor operatively connected to the hydraulic winch motor and configured to generate pressure differential data indicative of a pressure differential between the first port and the second port; and an electronic controller configured to:

access a winch load threshold, the winch load threshold defining a hold zone and a reel zone of the winch assembly, one of the hold zone and the reel zone including loads on the winch cable greater than the winch load threshold and another of the hold zone and the reel zone including loads on the winch cable less than the winch load threshold;

determine the pressure differential between the first port and the second port based upon the pressure differential data from the pressure differential sensor:

determine whether the winch assembly is operating within the hold zone or the reel zone based upon the tension data from the cable tension sensor including the pressure differential;

generate a zero flow command to prevent flow of hydraulic fluid to the hydraulic winch motor while the winch assembly is operating within the hold zone and preventing rotation of the hydraulic winch motor; and generate a pressure differential command to permit a desired flow of hydraulic fluid to the hydraulic winch motor at a desired pressure differential while the rotatable winch drum is operating within the reel zone, the desired flow of hydraulic fluid being based upon the winch load threshold and operating to permit rotation of the hydraulic winch motor.

2. The system of claim 1, wherein the reel zone corresponds to an upper reel zone and the upper reel zone includes loads greater than the winch load threshold and the hold zone includes loads less than the winch load threshold.

3. The system of claim 1, wherein the reel zone corresponds to a lower reel zone and the lower reel zone includes loads less than the winch load threshold and the hold zone includes loads greater than the winch load threshold.

4. The system of claim 1, wherein the winch load threshold corresponds to an upper load threshold and the reel zone corresponds to an upper reel zone, and the electronic controller is further configured to:

access a lower load threshold and the lower load threshold defines a lower reel zone;

determine whether the winch assembly is operating within the hold zone, the upper reel zone, or the lower reel zone based upon the pressure differential;

generate an upper pressure differential command while the rotatable winch drum is operating within the upper reel zone, the upper pressure differential command being based upon the upper load threshold and operating to reel-out a length of the winch cable; and generate a lower pressure differential command while the rotatable winch drum is operating within the lower reel zone, the lower pressure differential command being based upon the lower load threshold and operating to reel-in a length of the winch cable.

5. The system of claim 1, wherein the hydraulic winch motor is a variable displacement motor.

6. The system of claim 5, wherein the electronic controller is further configured to determine a displacement of the hydraulic winch motor and determine whether the winch assembly is operating within the hold zone or the reel zone further based upon the displacement of the hydraulic winch motor.

7. The system of claim 1, further comprising a prime mover and a pump, the prime mover being configured to rotate the pump, and the pump being hydraulically connected to the hydraulic winch motor.

8. The system of claim 7, further comprising a valve disposed between the pump and hydraulic winch motor, the valve being movable between a first operative position at which flow through the valve is prevented, and a second operative position at which flow through the valve is permitted to permit flow from the pump to the first port of the hydraulic winch motor, and a third operative position at which flow through the valve is permitted to permit flow from the pump to the second port of the hydraulic winch motor.

9. The system of claim 8, wherein the valve is an electrically controlled, proportional valve.

10. The system of claim 7, wherein the pump is a variable displacement pump and the electronic controller is operative to maintain the variable displacement pump at zero displacement when operating the winch assembly in the hold zone.

11. The system of claim 1, the electronic controller is further configured to access a winch dimensional characteristic of the rotatable winch drum, and determine whether the winch assembly is operating within the hold zone or the reel zone based upon the winch dimensional characteristic of the rotatable winch drum.

12. The system of claim 11, wherein the electronic controller is further configured to determine whether the winch assembly is operating within the hold zone or the reel zone based upon a displacement of the hydraulic winch motor.

13. The system of claim 1, further comprising a rotation sensor configured to generate rotational data indicative of an angular position of the rotatable winch drum, and the electronic controller is further configured to:

access a winch dimensional characteristic of the rotatable winch drum, determine a distance of the winch cable from a center of rotation of the rotatable winch drum based upon the rotational data and the winch dimensional characteristic of the rotatable winch drum; and determine whether the winch assembly is operating within the hold zone or the reel zone based upon the distance of the winch cable from the center of rotation of the rotatable winch drum.

14. A method of electronically controlling an operation of a winch assembly, comprising:

accessing a winch load threshold, the winch load threshold defining a hold zone and a reel zone of the winch assembly, one of the hold zone and the reel zone including loads on a winch cable wrapped around a rotatable winch drum being greater than the winch load threshold and another of the hold zone and the reel zone including loads less than the winch load threshold;

determining a pressure differential between a first port of the hydraulic winch motor and a second port of the hydraulic winch motor based upon pressure differential data from a pressure differential sensor;

determining whether the winch assembly is operating within the hold zone or the reel zone based upon tension data from a cable tension sensor including the pressure differential, the cable tension sensor being operatively associated with the winch cable, the tension data being indicative of a tension on the winch cable;

generating a zero flow command to prevent flow of hydraulic fluid to a hydraulic winch motor while the winch assembly is operating within the hold zone and preventing rotation of the hydraulic winch motor; and generating a pressure differential command to permit a desired flow of hydraulic fluid to the hydraulic winch motor at a desired pressure differential while the rotatable winch drum is operating within the reel zone, the desired flow of hydraulic fluid being based upon the winch load threshold and operating to permit rotation of the hydraulic winch motor.

15. The method of claim 14, wherein the winch load threshold corresponds to an upper load threshold and the reel zone corresponds to an upper reel zone, and accessing a lower load threshold, the lower load threshold defining a lower reel zone;

determining whether the winch assembly is operating within the hold zone, the upper reel zone, or the lower reel zone based upon the pressure differential;

generating an upper pressure differential command while the rotatable winch drum is operating within the upper reel zone, the upper pressure differential command being based upon the upper load threshold and operating to reel-out a length of the winch cable; and generating a lower pressure differential command while the rotatable winch drum is operating within the lower reel zone, the lower pressure differential command being based upon the lower load threshold and operating to reel-in a length of the winch cable.

16. The method of claim 14, wherein the hydraulic winch motor is a variable displacement motor and further comprising determining a displacement of the hydraulic winch motor and determining whether the winch assembly is operating within the hold zone or the reel zone further based upon the displacement of the hydraulic winch motor.

17. The method of claim 14, further comprising accessing a winch dimensional characteristic of the rotatable winch drum, and determining whether the winch assembly is operating within the hold zone or the reel zone based upon the winch dimensional characteristic of the rotatable winch drum.

18. A machine, comprising:

a prime mover;

a ground-engaging drive mechanism operatively coupled to the prime mover to propel the machine;

a winch assembly including:

a rotatable winch drum;

a winch cable wrapped around the rotatable winch drum;

a hydraulic winch motor operatively connected to the rotatable winch drum, the hydraulic winch motor including a first port and second port for receiving hydraulic fluid;

a cable tension sensor operatively associated with the winch cable and configured to generate tension data indicative of a tension on the winch cable, the cable tension sensor comprising a pressure differential sensor operatively connected to the hydraulic winch motor and configured to generate pressure differential data indicative of a pressure differential between the first port and the second port; and an electronic controller configured to:

access a winch load threshold, the winch load threshold defining a hold zone and a reel zone of the winch assembly, one of the hold zone and the reel zone including loads on the winch cable greater than the winch load threshold and another of the hold zone and the reel zone including loads on the winch cable less than the winch load threshold;

determine the pressure differential between the first port and the second port based upon the pressure differential data from the pressure differential sensor;

determine whether the winch assembly is operating within the hold zone or the reel zone based upon the tension data from the cable tension sensor including the pressure differential;

generate a zero flow command to prevent flow of hydraulic fluid to the hydraulic winch motor while the winch assembly is operating within the hold zone and preventing rotation of the hydraulic winch motor; and generate a pressure differential command to permit a desired flow of hydraulic fluid to the hydraulic winch motor at a desired pressure differential while the rotatable winch drum is operating within the reel zone, the desired flow of hydraulic fluid being based upon the winch load threshold and operating to permit rotation of the hydraulic winch motor.

* * * * *